United States Patent [19]

Dunning, III

[11] 4,057,308

[45] Nov. 8, 1977

[54] COLLAPSIBLE WALL STRUCTURE FOR CABINETS OR CHESTS

[75] Inventor: John M. Dunning, III, Greensboro, N.C.

[73] Assignee: Dunning, Ltd., Sanford, N.C.

[21] Appl. No.: 690,399

[22] Filed: May 27, 1976

[51] Int. Cl.[2] ..... A47B 43/00

[52] U.S. Cl. ..... 312/262; 312/258; 312/330 R; 312/259

[58] Field of Search ..... 312/262, 111, 140, 140.1, 312/330, 330 SM, 268, 259, 260, 258

[56] References Cited

U.S. PATENT DOCUMENTS

| | | | |
|---|---|---|---|
| 1,151,491 | 8/1915 | MacDaniel | 312/258 |
| 2,149,882 | 3/1939 | Clements | 312/258 |
| 2,572,717 | 10/1951 | Gersten | 312/259 |
| 3,282,635 | 11/1966 | Himelreich | 312/330 X |
| 3,472,571 | 10/1969 | Himelreich | 312/259 |
| 3,556,626 | 1/1971 | Schock | 312/330 R |
| 3,612,639 | 10/1971 | Williams | 312/330 R |
| 3,881,794 | 5/1975 | Henning | 312/259 |
| 3,887,101 | 6/1975 | Adachi | 312/330 SM |
| 3,933,401 | 1/1976 | Lampe et al. | 312/330 R |

FOREIGN PATENT DOCUMENTS

| | | | |
|---|---|---|---|
| 1,640 of | 1911 | United Kingdom | 312/262 |

*Primary Examiner*—Paul R. Gilliam
*Assistant Examiner*—Victor N. Sakran

[57] ABSTRACT

Opposite side edges of a base wall are hingedly attached each to a corresponding edge of a pair of side walls and, in the erected state, define three walls of a boxlike enclosure. In its collapsed or shipping position the cabinet side walls are folded oppositely from their erected position on pivot-like hinge means so that they are positioned flat against the rear surface of the base wall. Shipping and storage requirements are significantly less as the flattened units may be stacked one atop another with no wasted space, yet are easily assembled by folding the sides 270° to their erect position.

2 Claims, 5 Drawing Figures

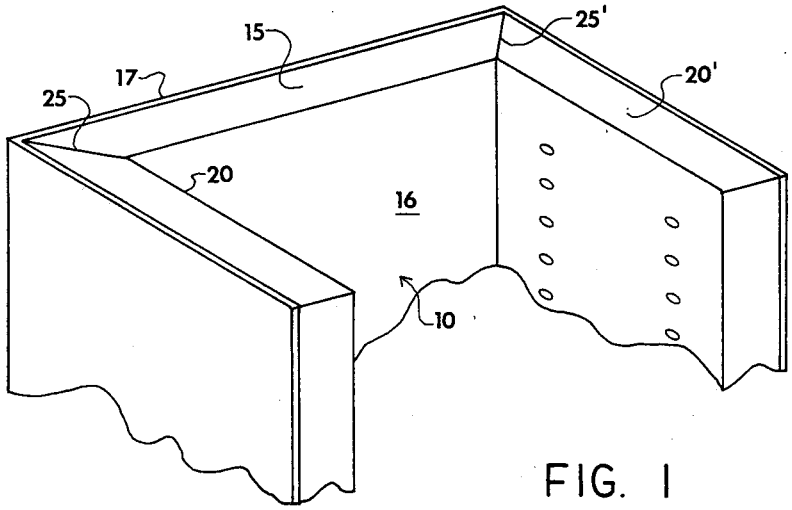
FIG. 1
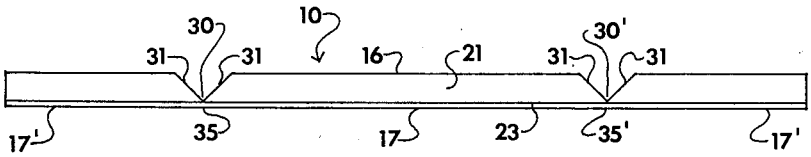
FIG. 2
FIG. 3
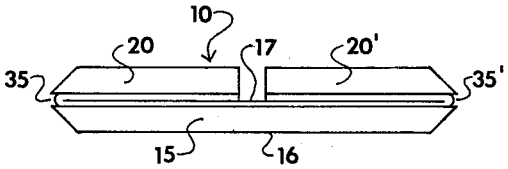
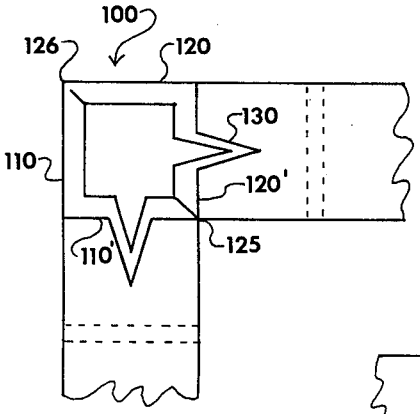
FIG. 4A
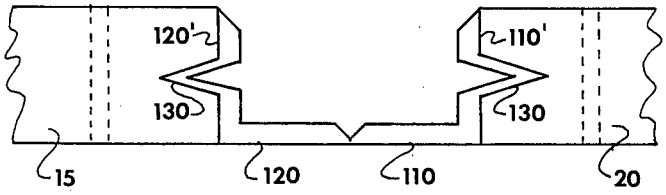
FIG. 4B

COLLAPSIBLE WALL STRUCTURE FOR CABINETS OR CHESTS

BACKGROUND OF THE INVENTION

Due to constant inflation and other economic factors it is becoming increasingly desirable for the furniture industry to provide consumers with furniture that is durable, versatile, and, very importantly, of reasonable cost. Today's consumer is concerned not only with styling and structural composition in the furniture he purchases, but equally with getting a good return on each dollar invested. Further, one of the goals in the marketing of collapsible furniture is for the product to be shipped in kit form and set up or assembled by the end consumer, thereby saving on the labor cost. Many consumers also desire units that may be economically shipped from place to place or stored as required in today's mobile society.

To this end, manufacturers have turned to furniture styling, particularly for cabinets, bookcases, chests, etc. which may be collapsed or "knocked-down" for shipping or storage. This collapsible or K-D design has necessitated the associated development of a variety of brackets, hinges and other means for erecting and securing the individual components together.

With particular reference to hinge devices pertinent to the present invention, the prior art includes, among others, U.S. Pat. No. 3,797,905 to Naske, which teaches the use of a flexible sheet material adhesively secured in hinge relation to the inner surfaces of the rear wall and respective side walls of an enclosure. This method does not yield a strong supporting joint and, in fact, a primary objective of the Naske patent is the provision of a dustproof seal in the joint between the connecting walls.

Another device known previously utilizes a flexible sheet material hinge around the outer surface of the rear corner joints and teaches the additional structural support of an interlocking joint.

U.S. Pat. No. 3,933,401 to Lampe et al discloses a prefabricated drawer which includes a molded one-piece polyvinylchloride slab having two v-shaped grooves cut across the width of the slab at the desired rear corner locations to define the back and side walls. When the drawer is to be erected the slanted edges of the v-shaped grooves are coated with adhesive, the points of the grooves are heated to facilitate bending, and the slab is then bent into position to define a back wall and two adjacent said walls. The adhesive coated groove edges permanently seal edge to edge to define the rear corners of the drawer. Another somewhat similar patent is U.S. Pat. No. 3,437,392 to Hilfinger.

Significant problems with the above prior art include: 1) initial lack of compactness when collapsed for shipping; 2) weakness of the hinge joint causing shakey unstable units; and 3) inability, after initial erection, to dismantle the unit for storage or moving.

SUMMARY OF THE INVENTION

The present invention is a prefabricated, foldable or collapsible wall structure for cabinet or chest enclosures which includes a base wall hingedly connected in a unique hinging system to a pair of opposing side walls.

In its collapsed state the present enclosure unit may be folded compactly for shipping or storage with the side walls positioned flat against the rear surface of the base wall by means of a hinging system built integrally into the wall structure which permits a 270° arcuate movement of the side walls around the longitudinal side edges of the base wall. When the unit is to be erected, the side walls are swung forwardly to a point where they extend forwardly at right angles to the front surface f the base wall to define three walls of a boxlike enclosure. With the integral hinging system, it is not necessary to attach any hinges, screws, or other fasteners during assembly or when collapsed.

In one preferred embodiment of the present invention, the wall structure is initially formed as a laminate sheet of a relatively thick wood or particleboard backing and a relatively thin skin of vinyl or other flexible polymeric material. The sheet dimensions equal the combined dimension of the base and side walls. A v-shaped groove extends from top to bottom through the wooden or particleboard thickness, but not through the vinyl backing, along a line defining each corner to be formed. By cutting the notches only partially through the board's thickness, a thin sheet thickness of vinyl is left to form the continuous outside surface of the cabinet. Further this thin, flexible vinyl thickness acts as a hinge on which the side walls may be moved approximately 270° from a collapsed position folded back against the rear surface of the base wall to a second, erected position.

In another embodiment, the base wall and side walls are fabricated separately and a unique hinge is attached to corresponding side edges of the base and side walls. The hinge for this second embodiment may be extruded, molded or otherwise formed and includes the vinyl hinging concept which in itself is not new; however, is new in the manner in which it is combined with modular, planar components as described herein.

It is therefore a primary object of the present invention to provide a collapsible wall structure for cabinets or chests which may be compactly folded and easily set up with a minimum of effort and hardware on the part of the end consumer.

It is a further object of the present invention to provide a collapsible wall structure for cabinets or chests which may be repeatedly set-up and disassembled for economical shipping and/or storage.

It is also an object of the present invention to provide a collapsible wall structure for cabinets or chests that, when erected, provides a sturdy, durable unit.

Still further objects and advantages of the present invention will become obvious to those skilled in the art upon reviewing the following detailed description in conjunction with the accompanying drawings, in which:

FIG. 1 is a perspective view of the upper end of an enclosure formed with a wall structure according to the present invention;

FIG. 2 is an end view of the wall structure according to one preferred embodiment of the present invention in its unfolded, flat position;

FIG. 3 is an end view of the wall structure of FIG. 2, except in the folded, shipping/storage position; and FIG. 4A is a top view of another embodiment of the present invention illustrating one corner of a wall structure connected by an alternate type of hinge mechanism.

FIG. 4B is a top view, similar to FIG. 4A, except illustrating the alternate type of hinge in the open position.

DETAILED DESCRIPTION OF A PREFERRED EMBODIMENT

Referring to FIG. 1 of the attached drawings, the wall structure for cabinets, chests, and the like according to the present invention are generally denoted by the numeral 10. Wall structure 10 includes a base or, in this case, rear wall 15 having a front surface 16 and a rear surface 17, and a pair of opposing side walls 20,20'. In the erected position as illustrated by FIG. 1, the wall structure 10 defines the rear and side walls of a chest or bookcase to which may be added sliding drawers, shelves, and a top or bottom. The drawers, shelves, top or bottom may be secured to the walled enclosure 10 by any of several conventional methods generally known to the furniture industry, such as, for example, those illustrated by U.S. Pat. Nos. 3,731,343 and 3,580,535 to Naske. Naske shows a system of pins and connectors for assembling and disassembling tops, bottoms, shelves, drawer slides, doors, and the like to spaced side walls without nails, screws, or other time consuming and not easily disconnected type fasteners.

The side walls 20,20' are hingedly connected to the back wall 15 at rear corner joints 25,25'. In FIGS. 2 and 3 the connecting hinge means between the rear and side walls is illustrated in the flat and folded-up position, while in FIG. 1, the hinge means is in the erected position.

FIGS. 1-3 are illustrative of one embodiment in which the base and side walls are formed from a single sheet 21 of wood or particleboard with a thin skin 23 of flexible vinyl or other polymeric material covering the outer surface.

Initially the vinyl covered wooden sheet 21 is formed as a continuous flat board of a height equal to the height of wall structure 10 and a length equaling the combined lengths of base wall 15 and both side walls 20,20'. Notches 30,30' are cut through the wooden sheet 21, but not through the vinyl skin 23, and extend vertically in spaced parallel relationship the full width of the board (FIG. 2). The notches 30,30' are positioned at the juncture of the base and side walls to define the rear corner of the enclosure.

Because the notches 30,30' are not cut completely through the board, a thin skin of uninterrupted vinyl is left surrounding the outer or rear corners of the enclosure. This thin skin 23 acts as a flexible hinge 35,35' at each rear corner of the enclosure, permitting the wall structure 10 to be repeatedly swung from a first, set-up position (FIG. 1) to a second, collapsed position (FIG. 2) through an angle of approximately 270°.

For shipping and/or storage, the enclosure 10 may be folded into a position where side walls 20,20' are pivoted backwards to a point where their outer surfaces 17' lie against the rear surface 17 of the base wall 15 (FIG. 3). In this position the unit is compact and may be easily stacked with other units for more economical shipping or storage than would be otherwise possible.

Hinges 35,35', or other similar hinges as will be hereinafter described, are most important to the present invention because of the durable yet flexible design which is an integral part of the enclosure structure and, therefore, requires no special installation. With the present invention no hardware is required to secure the sides to the back and no special reinforcing strips need be applied around the corners. Further, the bevelled internal edges 31 of the notches 30,30' bear against each other in the set-up position to provide added strength and rigidity. Since the aforementioned bevelled edges 31 are not adhesively secured to each other when the unit is erected, as in the earlier mentioned Hilfinger U.S. Pat. No. 3,437,392, the enclosure may be disassembled easily and repeatedly without damage to the hinged joint.

An alternate hinge device 100 is illustrated in FIG. 4 as an example of an extruded hinge, which may be used when it is desirable to use wooden material for the wall structure without a vinyl skin 23.

Hinge 100 is made from a plastic material that is extruded into a generally square, hollow member of any desired length, and is used to connect the base and side walls 15,20 of an enclosure. The hinge comprises two outer walls 110,120 which are respectively adjacent inner walls 110', 120'. The corner 125 is cut through so that the adjacent edges of walls 110', 120' are not attached to each other in any manner and are free to separate as illustrated in FIG. 4B. Corner 126 at the juncture of walls 110,120 is continuous or, if cut, is only cut partially through the wall thickness so as to form the hinge 100.

Each of inner walls 110', 120', include longitudinally extending wedge-shaped protrusions 130 to fit tightly into correspondingly notched edges of the base and side walls of the enclosure. The hinge 100 may be opened and pivoted 270° for folding and unfolding the enclosure as previously described, at the juncture 126 of outer walls 110,120. It is also intended that a similar hinge design could be formed without the wedges 130 by stapling the hinge walls 110', 120' to the edges of base and side walls 15,20.

Various modifications of the above-described invention will be apparent to those skilled in the art and may be made without departing from the scope of the invention as claimed.

What is claimed is:

1. A foldable wall structure for prefabricated cabinet or chest enclosures comprising:

a. a base wall having front and rear surfaces;

b. a pair of opposing side walls each having inner and outer surfaces;

c. a foldable hinge means permanently secured to said wall structure and connecting said base wall to each of said walls along adjacent edges;

d. said hinge means including an elongated, rectangular, tubular plastic extrusion extending transversely to the longitudinal axis of said base wall and side walls, said rectangular extrusion being formed of a pair of perpendicularly arranged outer walls and a pair of perpendicularly arranged inner walls, said inner and outer walls being connected together to form said rectangular extrusion, said plastic extrusion being at least partially continuous between the adjacent edges of said exterior walls and being completely discontinuous between adjacent edges of said interior walls, and a means for connecting each of said interior walls to the adjacent edge of one of said side walls and said adjoining edge of said base wall, whereby said extrusion hingedly connects a side edge of said base wall to the adjacent side edge of each of said side walls; and e. said side walls being foldable around said hinge means between a first, erect position wherein said side walls extend perpendicularly forward from the edges of said base wall and a second, shipping/storage position wherein said side walls are folded substantially 270° from said first position to lie flat against the rear surface of said base wall.

2. A foldable wall structure for prefabricated cabinet or chest enclosures comprising:

a. a base wall having front and rear surfaces;

b. a pair of opposing side walls each having inner and outer surfaces;

c. a foldable hinge means permanently secured to said wall structure and connecting said base wall to each of said walls along adjacent edges;

d. said hinge means including an elongated, rectangular, tubular plastic extrusion extending transversely to the longitudinal axis of said base wall and side walls, said rectangular extrusion being formed of a pair of perpendicularly arranged outer walls and a pair of perpendicularly arranged inner walls, said inner and outer walls being connected together to form said rectangular extrusion, said plastic extrusion being at least partially continuous between the adjacent edges of said exterior walls and being completely discontinuous between adjacent edges of said interior walls, and a means for connecting each of said interior walls to the adjacent edge of one of said side walls and said adjoining edge of said base wall, whereby said extrusion hingedly connects a side edge of said base wall to the adjacent side edge of each of said side walls; and e. said connecting means including a longitudinally extending, wedge shaped protrusion along each of said interior walls, and a correspondingly shaped groove extending along the adjacent edges of said base and side walls receiving said protrusion;

f. said side walls being foldable around said hinge means between a first, erect position wherein said side walls extend perpendicularly forward from the edges of said base wall and a second, shipping/storage position wherein said side walls are folded substantially 270° from said first position to lie flat against the rear surface of the base wall.

* * * * *